United States Patent [19]

Nozick

[11] Patent Number: 4,635,359

[45] Date of Patent: Jan. 13, 1987

[54] METHOD OF MANUFACTURING MULTI-TERMINAL ELECTRICAL CONNECTOR

[76] Inventor: Jacques Nozick, 28 rue Broca, 75005 Paris, France

[21] Appl. No.: 685,658

[22] Filed: Dec. 24, 1984

[30] Foreign Application Priority Data

Dec. 23, 1983 [FR] France ..... 83 20665

[51] Int. Cl.[4] ..... H01R 43/20

[52] U.S. Cl. ..... 29/878; 174/117 FF; 339/176 MF

[58] Field of Search ..... 29/876, 878, 877; 339/17 F, 176 MF; 156/55; 174/117 F, 117 FF

[56] References Cited

U.S. PATENT DOCUMENTS

| | | | |
|---|---|---|---|
| 3,082,398 | 3/1963 | Valach | 339/17 F X |
| 3,189,864 | 6/1965 | Angele et al. | 339/176 MF |
| 3,522,652 | 8/1970 | Gordon | 339/17 F X |
| 3,547,718 | 12/1970 | Gordon | 156/55 |
| 3,772,775 | 11/1973 | Bonnke et al. | 339/17 F X |
| 3,820,053 | 6/1974 | Champion et al. | 339/176 MF X |
| 4,172,626 | 10/1979 | Olsson | 339/176 MF X |
| 4,906,915 | 9/1983 | Lang | 174/117 FF X |

FOREIGN PATENT DOCUMENTS

| | | | |
|---|---|---|---|
| 2453941 | 5/1976 | Fed. Rep. of Germany | 174/117 F |
| 2553725 | 10/1976 | Fed. Rep. of Germany | 174/117 FF |
| 53-14395 | 2/1978 | Japan | 29/877 |
| 235072 | 6/1925 | United Kingdom | 174/117 F |

*Primary Examiner*—Howard N. Goldberg
*Assistant Examiner*—Carl J. Arbes
*Attorney, Agent, or Firm*—Sughrue, Mion, Zinn, Macpeak, and Seas

[57] ABSTRACT

Connectors are made by applying flat cable techniques. A sheet of conductors (1*a*–1*d*) is covered on both faces by respective strips of insulating material which are made to adhere to each other and to the conductors. Gaps are left in the strips to leave portions of the conductors bare. The resulting sandwich is cut up to form connector blanks, which blanks are then shaped to obtain connectors which may have various shapes depending on the intended application.

6 Claims, 15 Drawing Figures

METHOD OF MANUFACTURING MULTI-TERMINAL ELECTRICAL CONNECTOR

The present invention relates to a method of manufacturing a multi-terminal electrical connector and also to connectors obtained by the method.

The object of the invention is to provide a multi-terminal connector at a relatively low cost price by applying an original method.

SUMMARY OF THE INVENTION

According to the present invention, the method of manufacturing a multi-terminal connector comprises the following steps:

a plurality of electrical conductors made of a material having an elastic memory are disposed in parallel in a plane sheet;

the sheet is covered with at least one strip of insulating material in such a manner as to maintain the conductors in their relative dispositions;

a connector blank is cut out from the covered sheet; and the blank is folded to constitute a connector.

According to a preferred implementation of the invention, a strip of insulating material is applied to each side of the sheet of conductors. By using strips which are heat weldable, it is possible to apply the strips to the sheet under heat and pressure to obtain a uniform assembly. However, in some cases only one strip need be applied, which strip adheres to the conductors or which covers them completely when the strip material is softened.

According to an advantageous implementation of the invention, at least one of the strips of insulating material includes openings.

The invention also provides connectors obtained by application of the above-defined method.

BACKGROUND OF THE INVENTION

It is known to maintain a plurality of conductors (e.g. flat or round copper conductors) in a sandwich between insulating strips, thereby constituting flat cables. It is also known to strip a portion of such cables to make connections to the conductors. Further, it is known to use insulating strips which include openings (whether facing or otherwise) in order to make connections to the conductors. The bare conductors merely provide a contact surface. In order to obtain an electrical contact, two contact surfaces must simultaneously be present and must press one against the other.

It is also known to use contacts which are cut out from a metal strip at the same pitch as the connector into which they are to be inserted. The great advantage of this technique is to enable a large number of contacts to be simultaneously inserted into a connector by means of relatively simple tools. However, there remains the considerable problem of detaching the individual contacts from the portions of web that remain after the cutting out operation in order to electrically isolate the contacts from one other. This requires a separation operation followed by transfer into a bezel prior to insertion of the now-independent contacts into the connectors.

It is also known to mold the insulating body of the connector over a plurality of contacts. This is a relatively long and expensive technique since it requires a mold and prior guidance of the contacts.

None of these arrangements is capable of providing a multi-terminal connector of high quality at a cost price comparable to that provided by the present invention.

BRIEF DESCRIPTION OF THE DRAWINGS

Embodiments of the invention are described by way of example with reference to the accompanying drawings, in which.

MORE DETAILED DESCRIPTION

Figure 1:
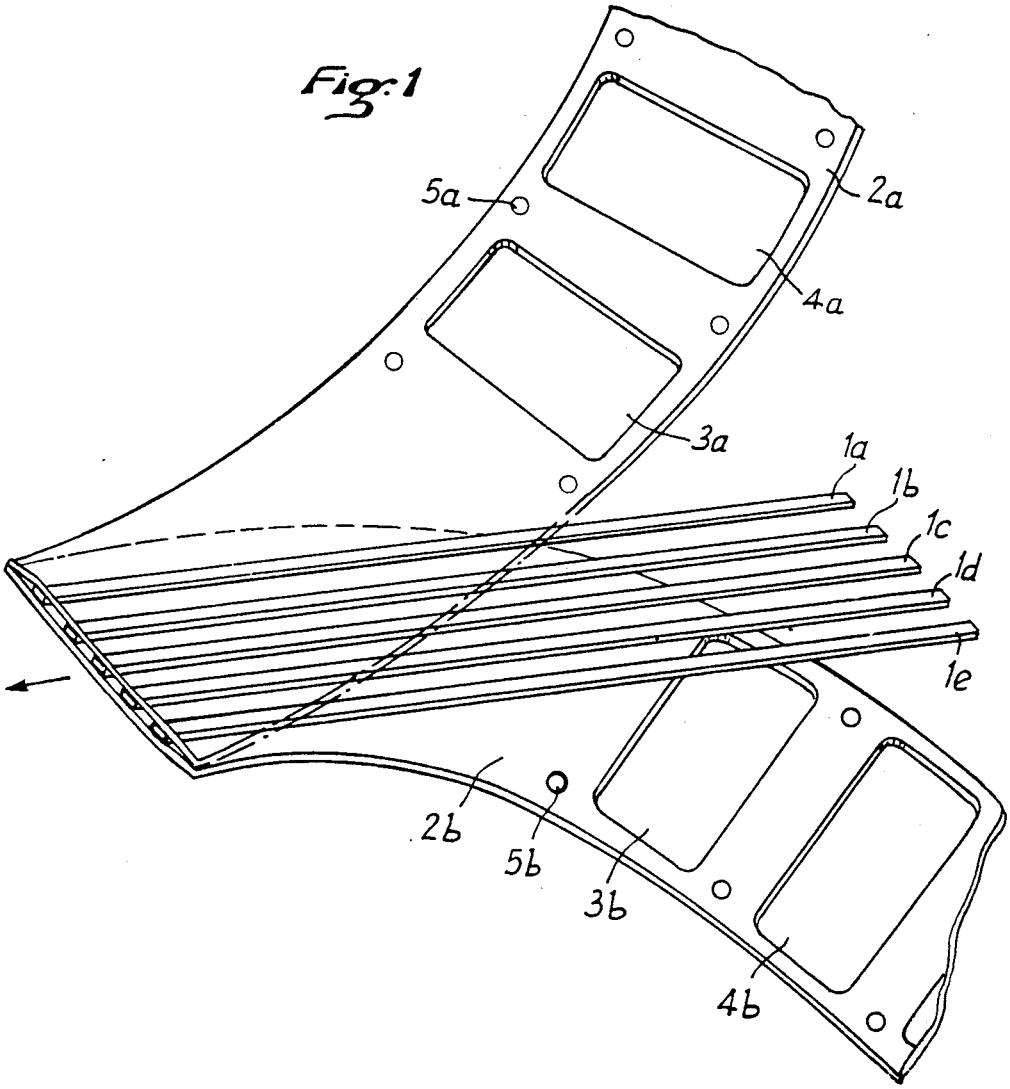
FIG. 1 is a diagrammatic perspective view showing the method of the present invention for manufacturing one example of the connector.

FIG. 1 is a diagram showing one implementation of the method in accordance with the present invention. A sheet of conductor wires 1*a* to 1*e* is formed (with five wires in this example). The number of wires is not limiting, the wires may be identical or otherwise, they may be flat or round or otherwise, and they be regularly spaced or otherwise depending on the intended use of the final connectors. In order to ensure elastic or resilient contact pressure, the conductors are made of a material having elastic memory (resilience), i.e. they are made of the metals which are usually used for making contacts, and they may optionally be coated with contact materials.

Two strips of flexible insulating material 2*a* and 2*b* are applied to the opposite large faces of the sheet of conductors 1, and they are fixed to each other and optionally to the conductors by any suitable means. One suitable means consists in using strips of plastic material which may be welded by heat and pressure. However, ultrasonic welding may be used as may glue or any other means giving an equivalent result.

The method may operate continuously, with a sheet of wires 1 being regularly unwound from bobbins and with known means for aligning them and keeping them taut. The sheet is wound onto a drum and the strips of heat weldable material are unwound on each face of the sheet and then compressed between two hot rolls, for example.

In an advantageous implementation of the present invention, the strips 2a and 2b include openings 3a, 4a . . . 3b, 4b and positioning and drive holes 5a, 5b for ensuring proper relative positioning of the openings. The openings in the two strips may be the same, or they may be different. If they are different they may differ in size and/or position. Consecutive openings may be different from one another or they may be differently spaced, depending on the type of connector to be made and as explained below.

Figure 2:
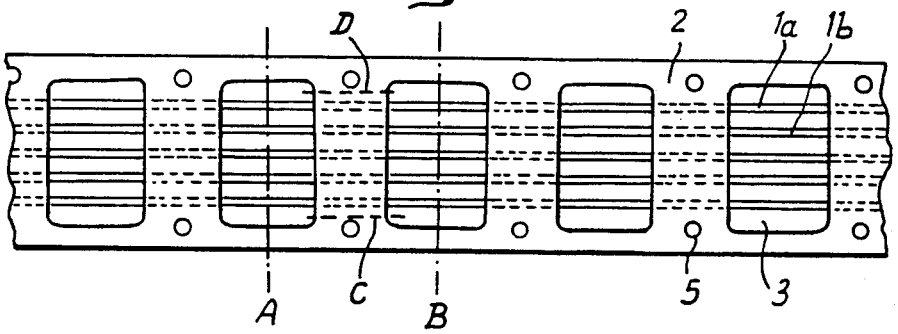
FIG. 2 is a plan view showing an intermediate product in the method in accordance with the invention.

With the example shown in FIG. 1, a continuous strip is obtained and a length of this strip is shown in plan view in FIG. 2. This strip comprises a support 2 having windows and drive holes 5 together with conductors 1 which are bare where they pass through the windows and which are otherwise embedded in the strip of material and are held thereby.

It would be possible, although less advantageous, to use strips without windows and to subsequently strip the wires at desired locations, e.g. by milling.

Figure 3:
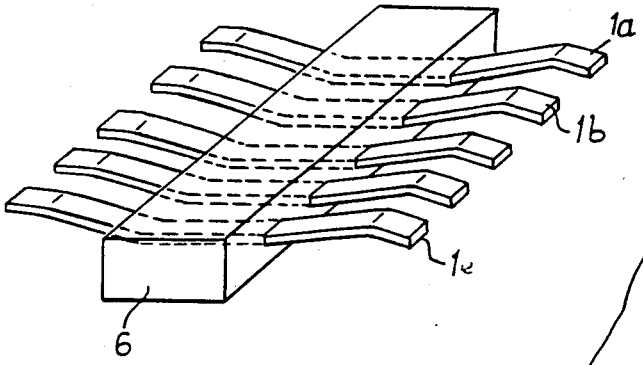
FIG. 3 is a perspective view of an example of a connector in accordance with the invention obtained by the method illustrated in FIGS. 1 and 2.

To make connectors, the strip is cut up into suitable lengths,, e.g. at a pitch corresponding to the pitch of the openings. For example, the strip may be cut along dot-dashed lines A and B and then the unwanted margins are removed by cutting along the dashed lines C and D. This provides a connector blank. The blank is then folded to constitute a connector. An example is shown in FIG. 3. The connector has a body strip in which the middle portions of connector blades 1 are embedded. The various blades may be identically folded or bent, or they may be differently folded or bent, depending on the intended application. The conductors may be folded or bent lengthwise to form trough-shaped members.

Figure 3A:
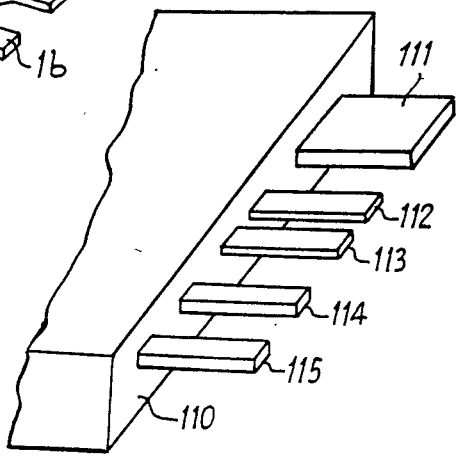
FIG. 3A is a perspective view of a portion of a variant connector.

It will be understood that numerous types of connector can be made in this way including one or more bodies 6, and one or more bunches of blades with the body and/or the blades being folded or bent once or several times in any suitable direction. By way of example, FIG. 3A shows a sheet of conductors for a connectors including a power contact 111, two signal contacts 112 and 113 which are separated by a relatively small gap and two other contacts 114 and 115 which are thicker than the signal contacts and more widely spaced. The power contact is much larger than the other contacts. The conductors are embedded in insulating material 110.

There now follows descriptions of various connectors which can be made using the method of the invention.

Figure 4:
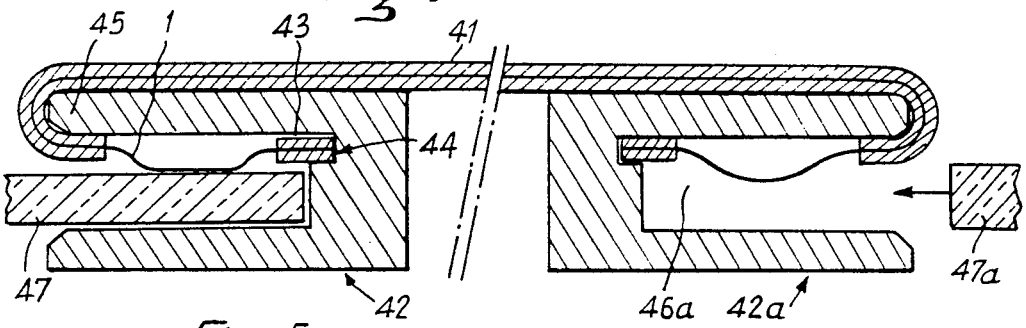
FIG. 4 is a cross-section through a further example of a connector in accordance with the invention suitable for interconnecting two independent printed circuits.

FIG. 4 shows a flexible connection cable 41 having two identical connectors 42 and 42a, one at each end. The tips 43 of the cable are embedded in a portion of insulating material to maintain the conductors at the design pitch, and the tips 43 are received in slots 44. The conductors are bared over a portion of the cable close to each end and then the cable is folded round an edge 45 of the inlet slot 46a of each connector. The cable is fixed by any suitable means to the body of the connector 42 (screws, gluing, or any other suitable means). A card 47 can then be inserted into the connector slot and multiple contacts are made with the row of contacts formed by the conductors 1 which are suitably bent or folded to obtain a spring effect to supply contact pressure. The cable may be of any desired length. In this example, the conductors could be bared on one side only, however the spring effect is improved if the conductors are not backed by plastic strip material.

Figure 5:
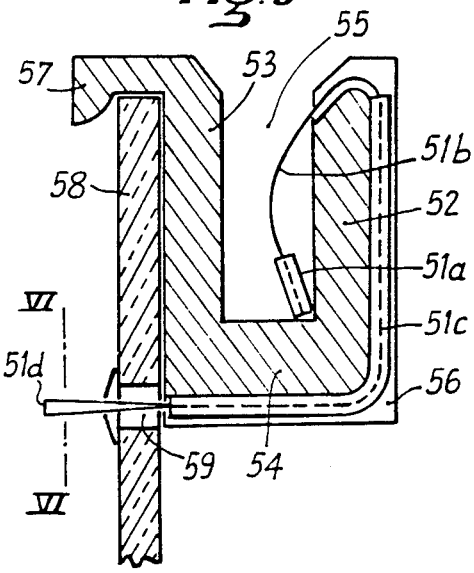
FIG. 5 is a section through an example of a connector which may be soldered to a printed circuit.
Figure 6:
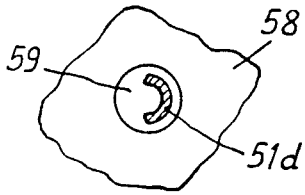
FIG. 6 is a section on a line VI—VI of FIG. 5.

FIG. 5 shows another example. The FIG. 5 connector is built around a blank which comprises a first embedded end 51a which is relatively short, a bared portion 51b forming a row of contacts, a relatively long link portion 51c which is embedded in insulating material, and a second end 51d which is bared. This blank is wound around one wall 52 of a female connector for receiving the edge of a printed circuit card, and including a second wall 53 and a bottom 54 which together define a slot 55 in which the printed circuit card or other male contact may be engaged. Ribs 56 may be provided to hold the flat cable 51 in position and may be fixed to the body 52–54 by any suitable means. The wall 53 on one side of the slot 55 is terminated by an outwardly directed hook 56 for locating the connector on the edge of a printed circuit card 58. The card 58 includes perforations 59 through the ends 51d of the conductors are passed to enable them to be soldered to the circuits of the card 58. The insulating plastic material used in this embodiment is preferably chosen so that the plastic withstands the temperatures of wave or flow soldering. The section of the conductors 51d may be longitudinally curved as shown in FIG. 6.

Figure 7:
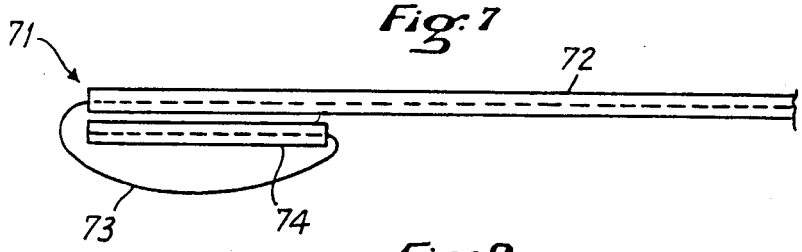
FIG. 7 is an elevation side view of a non-reversible plug-in flat cable made by the method in accordance with the invention.

FIG. 7 is a diagram of a non-reversible plug-in flat cable 71. It is constituted in three parts: a main part 72 of unlimited length having a righthand end (not shown) connected to any suitable connection or connector: a contact part 73 in the form of bare conductors; and an end 74 folded against the flat cable 72 and preferably fixed thereto. Said end part 74 retains its insulation and serves to keep the wires relatively positioned. This provides a multi-terminal electrical contact which is resilient, practical and cheap.

Figure 8:
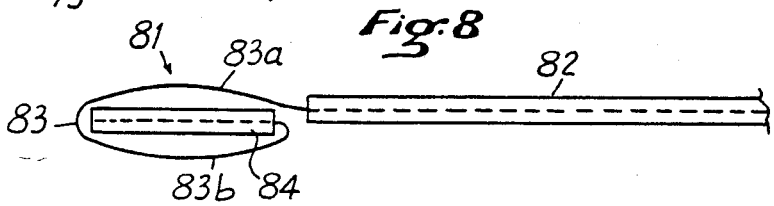
FIG. 8 is a similar view of a flat cable which is reversible.

FIG. 8 shows a reversible flat cable 81 comprising essentially the same three parts 82, 83 and 84 as the cable shown in FIG. 7, but differently disposed. The portion 83 which is bared of its insulation, forms a contact over both faces of the end part 84. In other words, the flat cable may be inserted either way up into a connector, and either a portion 83a or a portion 83b of the stripped part 83 will make contact with a conductor in the connector.

Figure 9B:
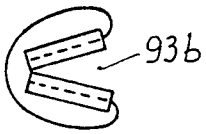
FIGS. 9*b*, 9*c* and 9*d* show variants of the contacts for the FIG. 9*a* support.
Figure 9C:
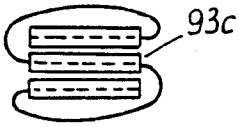
Figure 9D:
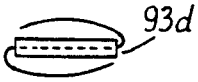
Figure 9A:
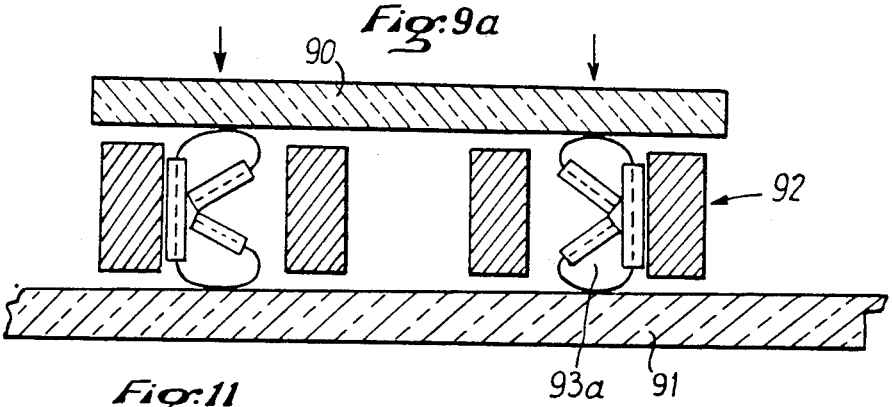
FIG. 9*a* is a section through a support for mounting a component on a printed circuit and made by the method in accordance with the invention.

FIG. 9a shows an application of the method of the invention to providing a component-supporting connector. The component 90 is connected to a printed circuit 91 by means of a connector 92 comprising two identical members 93a lodged in housings in the connector. Each member 93 comprises five parts: three parts covered in insulator separating two lengths of bared conductor which are suitably curved to obtain the desired elasticity. Other variants of the contact members 93b, 93c and 93d are shown diagrammatically in FIGS. 9b, 9c and 9d.

Figure 11:
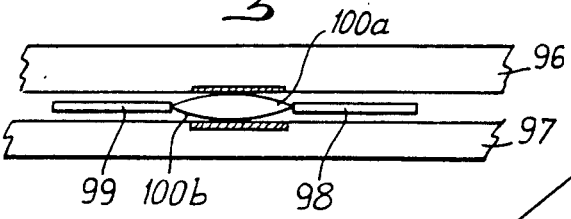
FIG. 11 shows the connector in place.
Figure 10:
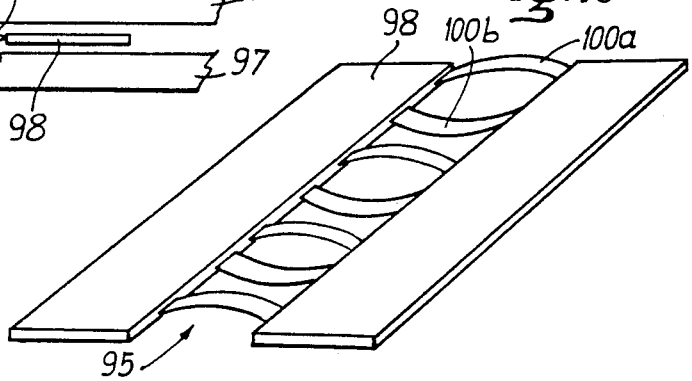
FIG. 10 is a perspective view of a connector for linking together two printed circuits.

FIGS. 10 and 11 show another example of an application of the invention to a connector 95 for linking two printed circuit cards 96 and 97. The connector comprises two insulated portions 98 and 99 which serve to maintain a grid of contacts 100 therebetween. Every other contact 100a is curved upwardly while the intermediate contacts 100b are curved downwardly to provide the connector with varying thickness and with elastic contacts.

The above examples show the variety of connectors which may be made using the method of invention. Once a connector has been designed, the number, shape and spacing of the conductors need to be set and suitable insulating strips need to be designed in order to provide an arbitrary length of connector blank material.

The blanks are then formed by cutting up this length and throwing away waste portions.

The present invention combines the advantages of flat cables: a plurality of parallel conductors which are mutually insulated, together with preformed electrical contacts which are held on carriers enabling a plurality of contacts to be transferred simultaneously into insulation.

By baring the conductors of the flat cable (or in practice by avoiding applying insulation thereto) and keeping them separate, shaping them and giving them suitable rigidity and elasticity, the following desirable features for a connector are obtained:

(a) a surface contact;

(b) resilient (elastic) contact force;

(c) contact security;

(d) each contact is independent, thus enabling the connector to adapt to geometrical irregularities in the contact surfaces with which they are to co-operate;

(e) the remaining insulation holds the contacts at a determined pitch; and (f) a large number of individual contacts are manipulated in a single operation.

This considerably simplifies the molding of housings for receiving the contacts in comparison with the housings of existing connectors. The molding details of current connectors considerably complicate the molds used and require great accuracy. The fact that the contacts in connectors of the present invention are held to each other by an insulating member makes it possible to fix them easily by means which cooperate with the contacts taken as a group or comb. The pitch may be accurately achieved which means that it is possible to obtain combs having "teeth" which are very close together, and in any case closer together than is possible using conventional connector techniques. For example, there is no difficulty in obtaining a pitch of 1.27 mm.

What is claimed is:

1. A method of manufacturing a multi-contact electrical connector for electrically interconnecting multiple contacts in two electrical circuits, comprising the steps of:

selecting a plurality of wires of a material having an elastic memory and having the desired cross-sectional geometries for mating said wires with said multiple contacts in said electrical circuits to be interconnected through said plurality of wires;

selecting the lengths of said wires to be at least as long as the distance between said electrical circuits over the route said wires will run between said electrical circuits;

arranging the selected wires of selected lengths side by side in a common plane;

preparing a first sheet of insulating material to have a width greater than the distance between the outside edges of the two outside ones of said plurality of side by side wires and a length at least as great as said selected lengths of said wires;

forming a plurality of apertures at selected positions equally spaced apart along the length of said first sheet;

preparing a second sheet of insulating material to have a width greater than the distance between the outside edges of the two outside ones of said side by side wires and a length at least as great as said selected lengths of said wires;

sandwiching said side by side wires between said first and second sheets, said wires being exposed through said apertures;

transversely cutting through said sandwiched first and second sheets and said wires across two longitudinally separated apertures to form a connector blank with exposed wires at both longitudinal ends thereof; and bending the exposed wires so that they will exert a resilient contact force upon said mating with said multiple contacts in said electrical circuits.

2. A method according to claim 1, further including the step of removing a portion of the insulating material by cutting or by milling.

3. A method according to claim 1, further including the step of fixing the connector blank to an insulating block.

4. A method according to claim 1 further including the step of heat welding the first and second sheet together.

5. A method according to claim 7 further including the step of forming a plurality of second apertures at said selected positions along the length of said second sheet so that said first and second plurality of apertures are transversely aligned and are congruent.

6. A method according to claim 4 further including the step of forming a plurality of second apertures at said selected positions along the length of said second sheet so that said first and second plurality of apertures are transversely aligned and are congruent.

* * * * *